US008851605B2

(12) United States Patent
Kubota et al.

(10) Patent No.: US 8,851,605 B2
(45) Date of Patent: Oct. 7, 2014

(54) IMAGE FORMATION APPARATUS UTILIZING A TRANSFER BELT

(75) Inventors: Mutsumi Kubota, Ibaraki-ken (JP); Masahiro Nishihata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 151 days.

(21) Appl. No.: 13/160,543

(22) Filed: Jun. 15, 2011

(65) Prior Publication Data

US 2011/0310153 A1 Dec. 22, 2011

(30) Foreign Application Priority Data

Jun. 18, 2010 (JP) ..... P2010-139434

(51) Int. Cl.
*B41J 29/38* (2006.01)
*B41J 11/00* (2006.01)

(52) U.S. Cl.
CPC ..... *B41J 29/38* (2013.01); *B41J 11/007* (2013.01)
USPC ..... 347/14

(58) Field of Classification Search
None
See application file for complete search history.

(56) References Cited

U.S. PATENT DOCUMENTS 5,674,019 A * 10/1997 Munakata et al. ..... 400/568
6,893,174 B2 * 5/2005 Askren et al. ..... 400/582
2005/0253920 A1 * 11/2005 Yoshimizu ..... 347/217
2007/0126837 A1 * 6/2007 Takahashi et al. ..... 347/104
2007/0297823 A1 * 12/2007 Oike ..... 399/66
2010/0290064 A1 * 11/2010 Hara et al. ..... 358/1.5
2011/0261372 A1 * 10/2011 Kerxhalli et al. ..... 358/1.5

FOREIGN PATENT DOCUMENTS

JP 2007-276286 A 10/2007
WO 2009/113597 A1 9/2009

OTHER PUBLICATIONS

Official Action cited in Japanese Patent Application No. 2010-139434 dated Mar. 11, 2014, two (2) pages.

* cited by examiner

*Primary Examiner* — Geoffrey Mruk
*Assistant Examiner* — Bradley Thies
(74) *Attorney, Agent, or Firm* — Nath, Goldberg & Meyer; Jerald L. Meyer

(57) ABSTRACT

An LDV meter 21 cooperates with an LDV processor 22 to measure travel distances or travel speeds of a transfer belt at a prescribed measuring spot and at intervals with a prescribed rotation angle of one of a set of rollers, on which the transfer belt is stretched, as a set for one or more go-around revolutions of the transfer belt. A roller profile calculator 242 calculates a roller profile data as a set of fractions attributable to an eccentricity of the set of rollers in a set of measurement data. A belt profile calculator 241 removes the set of fractions attributable to the eccentricity from the set of measurement data and calculates a belt profile data representative of irregularities in thickness of the transfer belt based on the set of measurement data after removal of the set of fractions attributable to the eccentricity. In printing, a printing machine 1 controls timing for discharge of ink at an ink head based on the belt profile data and the roller profile data.

2 Claims, 14 Drawing Sheets

IMAGE FORMATION APPARATUS UTILIZING A TRANSFER BELT

BACKGROUND OF THE INVENTION

1. Field of the Invention

The present invention relates to a printing system including a printing machine using a transfer belt for transferring a sheet to make a print thereon.

2. Description of Related Art

There have been known printing systems including a printing machine adapted to transfer a sheet as a print medium held on a transfer belt and to make a print thereon by propelling droplets of ink from an ink head onto the sheet.

When such a printing system is put in a printing service, the transfer belt is driven in a controlled manner for a constant travel speed. However, the travel speed of the transfer belt may change by so-called irregularities in thickness of the transfer belt in addition to similar affection by eccentricity of rollers over which the belt is stretched.

The transfer belt may thus travel at non-constant speeds causing droplets of ink propelled out of the ink head to be shot in positions deviated from desirable positions on a sheet, i.e. subject to so-called "shot deviations". Shot deviations debase the print quality of printed images.

To suppress such shot deviations, there has been a technique disclosed in a patent literature 1 (WO 2009/113597). This technique includes operations for storage of belt profile data representative of irregularities in thickness of a transfer belt and roller profile data representative of eccentricity of rollers over which the transfer belt is stretched, as they are extracted in advance. Then, it operates for use of a combination of belt profile data and roller profile data to control ink discharge timings, to suppress shot deviations.

The above-noted technique involves the use of an encoder detecting roller revolutions to measure a travel speed of the transfer belt every pulse outputted from the encoder in order to generate a belt profile data and a roller profile data. Then it employs data of such measurements to calculate therefrom an average travel speed for use to determine a speed ratio of a measured travel speed to the calculated average travel speed for each pulse.

A set of the determined speed ratios is employed as a data set constituting a basis for calculations to determine a set of fractions therein attributable to eccentricity of associated rollers, to provide the above-noted roller profile data. The data set of speed ratio is then processed to remove therefrom the set of fractions attributable to roller eccentricity, to provide the above-noted belt profile data.

SUMMARY OF THE INVENTION

According to the technique disclosed in the patent literature 1, in the process of generation of a belt profile data, there is a calculation to determine an average travel speed of the transfer belt, prior to processing the removal of fractions attributable to roller eccentricity.

However, in the above technique, since data on measured transfer speeds of the transfer belt includes fractions attributable to roller eccentricity, the average travel speed calculated from such measurement data also includes a fraction attributable to roller eccentricity. Such the average travel speed constitutes a basis for calculations to determine a set of speed ratios, so the belt profile data may not be sufficiently correct. As a result, the belt profile data may not be correct enough to exhibit due effects to suppress shot deviations.

The present invention has been devised in view of such issues. It is an object of the present invention to provide a printing system adapted to suppress shot deviations due to irregularities in thickness of a transfer belt and/or eccentricity of rollers over which the transfer belt is stretched.

To achieve the object described, according to an aspect of the present invention, there is a printing system comprising a set of rollers, a transfer belt driven by the set of rollers to transfer a sheet; an ink head configured to propel droplets of ink onto the sheet put on the transfer belt; a measuring element configured to measure travel distances or travel speeds of the transfer belt at a prescribed measuring spot and at intervals with a prescribed rotation angle of one of the set of rollers, as a set for one or more go-around revolutions of the transfer belt at a prescribed measuring spot; a roller profile calculator configured to calculate a roller profile data as a set of fractions attributable to an eccentricity of the set of rollers in a set of measurement data obtained at the measuring element; a belt profile calculator configured to remove the set of fractions attributable to the eccentricity from the set of measurement data, and calculate a belt profile data representative of irregularities in thickness of the transfer belt based on the set of measurement data after removal of the set of fractions attributable to the eccentricity; and a discharge controller configured to control timing for discharge of ink to the sheet at the ink head based on the belt profile data and the roller profile data, wherein the belt profile calculator calculates a set of eccentricity-removed average data representative of travel distances or travel speeds of the transfer belt at the measuring spot and at the intervals with the prescribed rotation angle of the roller as the transfer belt is traveling at a constant speed based on the set of measurement data after removal of the set of fractions attributable to the eccentricity, and calculate the belt profile data as a set of data on differences between the set of measurement data after removal of the set of fractions attributable to the eccentricity and the set of eccentricity-removed average data.

According to another aspect of the present invention, there is an ink discharge control method for a printing system including a transfer belt driven by the set of rollers to transfer a sheet, and an ink head configured to propel droplets of ink onto the sheet put on the transfer belt, the ink discharge control method comprising: measuring travel distances or travel speeds of the transfer belt at a prescribed measuring spot and at intervals with a prescribed rotation angle of one of the set of rollers, as a set for one or more go-around revolutions of the transfer belt, to provide as a set of measurement data; calculating a roller profile data as a set of fractions attributable to an eccentricity of the set of rollers in the set of measurement data; removing the set of fractions attributable to the eccentricity from the set of measurement data, for calculating a belt profile data representative of irregularities in thickness of the transfer belt based on the set of measurement data after removal of the set of fractions attributable to the eccentricity; and controlling timing for discharge of ink to the sheet at the ink head based on the belt profile data and the roller profile data, wherein the calculating step of the belt profile data comprises calculating a set of eccentricity-removed average data representative of travel distances or travel speeds of the transfer belt at the measuring spot and at the intervals with the prescribed rotation angle of the roller as the transfer belt is traveling at a constant speed based on the set of measurement data after removal of the set of fractions attributable to the eccentricity, and calculating the belt profile data as a set of data on differences between the set of measurement data after removal of the set of fractions attributable to the eccentricity and the set of eccentricity-removed average data.

BRIEF DESCRIPTION OF DRAWINGS

FIG. 14 is a graph showing examples of two sets of data on degrees of shot deviations under the test mode and the average data in between.

DETAILED DESCRIPTION OF EMBODIMENTS

There will be described embodiments of the present invention with reference to the accompanying drawings below. It is noted that equivalent parts or components in drawings are designated by equivalent reference signs for simplicity.

First Embodiment

Figure 1:
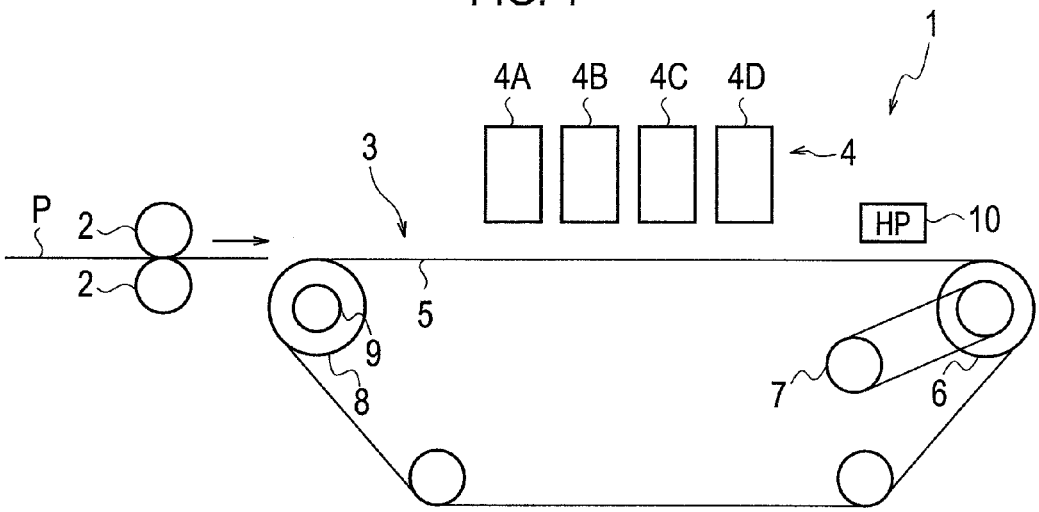
FIG. 1 is a diagram of schematic configuration of a printing machine constituting a printing system according to a first embodiment.

FIG. 1 is a diagram of schematic configuration of a printing machine constituting a printing system according to a first embodiment As shown in FIG. 1, according to the first embodiment, there is a printing machine 1 including a set of register rollers 2, a sheet transfer section 3, and a head unit 4.

The set of register rollers 2 is configured to reset a print sheet P, which has been picked up from a sheet feeder rack (non-depicted) and fed in a position, in a corrected position to avoid oblique transfer, and to send out to the transfer section 3 at a prescribed timing.

The transfer section 3 has a transfer belt 5 to be driven to go around with a top side facing the head unit 4, and includes a drive roller 6 for driving the transfer belt 5. The transfer section 3 includes: a drive motor 7 for driving the drive roller 6; and a driven roller 8 to be driven from the drive roller 6 through the transfer belt 5. The transfer section 3 further includes: an encoder 9 operable for each prescribed increment in rotation angle of the driven roller 8 to output a pulse signal; and a belt HP (home position) sensor 10 for detecting a reference mark (non-depicted) on the transfer belt 5 to output a belt HP signal.

The transfer belt 5 is stretched over the drive roller 6 and the driven roller 8 to follow the drive roller 6 to move in an endless manner, thereby carrying a sheet P set thereon by the set of register rollers 2. The transfer belt 5 includes: a belt member perforated with multiple air holes for communication with a sealed internal space; and a suction fan (non-depicted) connected to the internal space for suction through air holes to exert negative pressures on a sheet P to be held in position to carry.

The head unit 4 is composed of a set of ink heads 4A to 4D adapted to propel ink droplets onto a sheet P on the transfer belt 5 traveling on the transfer belt 5 to print images thereon.

Figure 2:
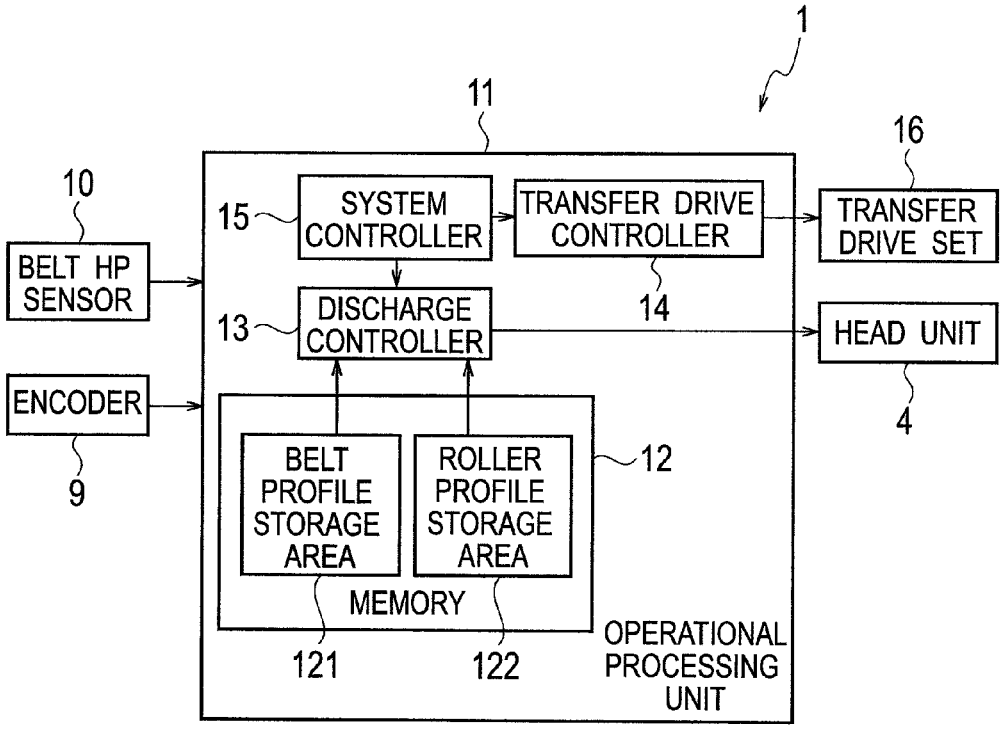
FIG. 2 is a block diagram showing a configuration of a control system of the printing machine in FIG. 1.

FIG. 2 is a block diagram showing a configuration of a control system of the printing machine 1. As shown in FIG. 2, the printing machine 1 includes an operational processing unit 11.

The operational processing unit 11 is configured as an operational module constructed from at least one of: a processor such as a CPU (central processing unit) or DSP (digital signal processor), memory; other electronic circuitry (hardware); and application programs (software) adapted to implement their functions. The operational processing unit 11 reads and executes program files to constitute various imaginary functional modules for processing data on images and controlling actions of constituents. Here the term "module" means a functional unit constructed from at least one of: hardware such as a device or instrument; and software implementing its function, to achieve a prescribed performance.

As shown in FIG. 2, the operational processing unit 11 includes a memory 12, an ink discharge controller 13, a transfer drive controller 14, and a system controller 15.

The memory 12 includes: a belt profile storage area 121 for storing: a set of belt profile data each given as a data on irregularities in thickness of the transfer belt 5; and a roller profile storage area 122 for storing a set of roller profile data each given as a data on an eccentricity of "a set of associated rollers including the driven roller 8 being a target of observation by the encoder 9" (hereinafter, collectively referred to as "driven roller 8" in this sense) over which the transfer belt 5 is stretched. This embodiment employs a later-described profile generator for generating belt profile data and roller profile data in advance. Thus prepared data sets are stored in the belt profile storage area 121 and the roller profile storage area 122 upon a factory acceptance test or such of the printing machine 1.

In this embodiment, it is noted that the driven roller 8 is selected as a target of encoder observation for the generation of roller profile data while there may be selected any associated roller else, e.g. the drive roller 6, as an observation target.

The discharge controller 13 is configured as a module to control timings for droplets of ink to be propelled out at the head unit 4. The discharge controller 13, which is configured to control timing for ink droplets to be propelled based on pulse signals from the encoder 9, is adapted in this embodiment to: correct pulse signals from the encoder 9 based on belt profile data and roller profile data stored in the memory 12; and control timings for ink droplets to be propelled based on the basis of corrected pulse signals.

The drive controller 14 is configured as a module to control actions of a transfer drive set 16 including the drive motor 7 for driving the drive roller 6 and a drive mechanism (non-depicted) for driving the set of register rollers 2.

The system controller 15 is configured to control actions of modules constituting the operational processing unit 11.

Description is now made of a profile generator used for generation of belt profile data and roller profile data.

Figure 3:
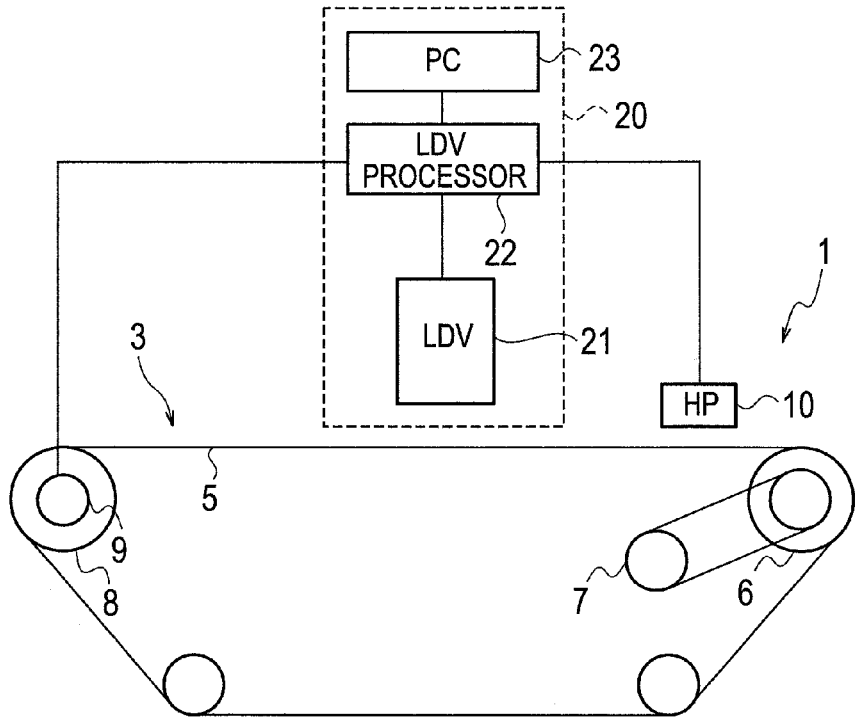
FIG. 3 is a diagram of schematic configuration of the printing system according to the first embodiment including a profile generator.
Figure 4:
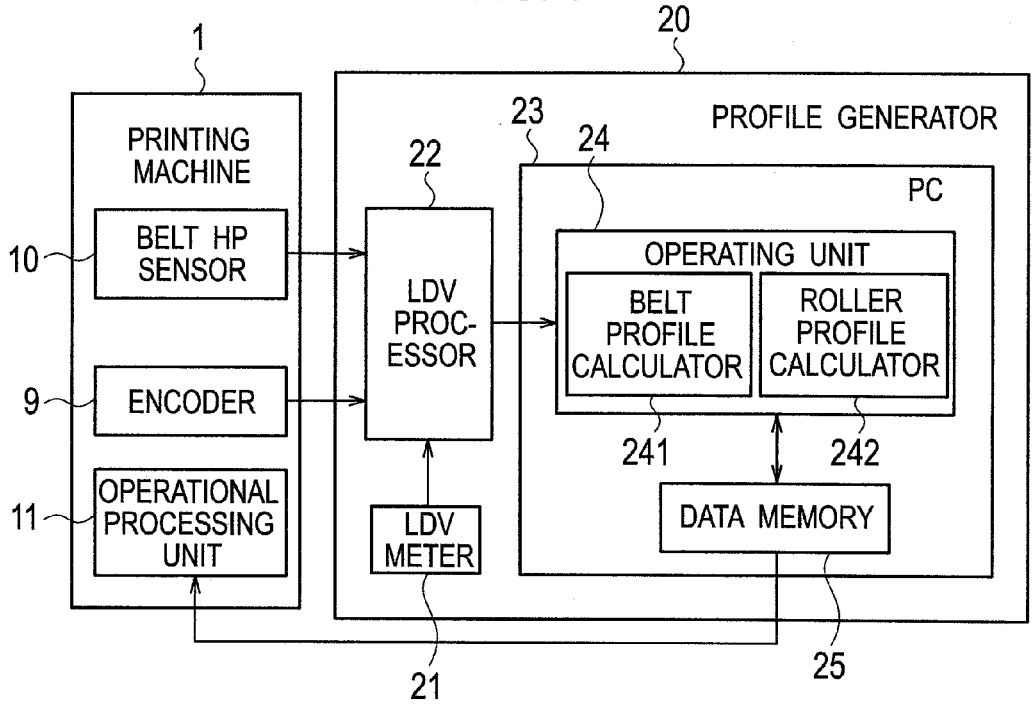
FIG. 4 is a block diagram of functional configuration of the profile generator in FIG. 3.

FIG. 3 is a diagram of schematic configuration of the printing system according to the first embodiment including a profile generator. FIG. 4 is a block diagram of functional configuration of the profile generator in FIG. 3.

As shown in FIG. 3, a profile generator 20 includes an LDV (laser Doppler velocity) meter 21, an LDV processor 22, and a PC (personal computer). The profile generator 20 is to be connected to the printing machine 1 for use such as in the course of fabrication, upon a factory acceptance test, and at maintenance services of the printing machine 1.

The LDV meter 21 is configured to irradiate a measuring spot on a moving object with coherent split laser beams for noncontact optical measurement of a velocity at the measuring spot. More specifically, it operates for a differential measurement of wave number between scattered fluxes of light frequency-shifted at irradiated regions to detect a Doppler frequency corresponding to a velocity in a prescribed direction at the measuring spot of the object. The LDV meter 21 is disposed above the transfer belt 5 to detect a travel speed of the transfer belt 5 at a measuring spot set thereon. The measuring spot may be set on a surface area of the transfer belt 5 directly beneath a center of the head unit 4 (non-depicted in FIG. 3) for instance.

It is noted that the LDV meter 21 is attachable to and detachable from the printing machine 1. The LDV meter 21 can thus be assembled to the printing machine 1 only when preparing profile data, to avoid having an expensive meter normally incorporated therein, thereby allowing for a reduced fabrication cost.

The LDV processor 22 is connected to the LDV meter 21, the encoder 9, and the belt HP sensor 10. The LDV processor 22 is configured to operate with a belt HP signal input thereto, to calculate an accumulated travel distance of the transfer belt 5 at the measuring spot for each pulse of pulse signals output from the encoder 9 (i.e., for each prescribed angle of rotation of the driven roller 8). A travel distance is obtained by converting a data on velocity input from the LDV meter 21 into a data on distance. The LDV processor 22 is thus cooperative with the LDV meter 21 to constitute an accumulated travel distance measuring device.

The PC 23 is an operational processing device provided with a CPU, which may be implemented as a dedicated device for a specific function, and is adapted for execution of software on the CPU to serve as a profile data generator. More specifically, as shown in FIG. 4, the PC 23 serving as a profile data generator includes an operating unit 24 and a data memory 25.

The operating unit 24 is configured as a module for use of data (as measurement data) on accumulated travel distances of the transfer belt 5 input thereto from the LDV processor 22, to have a belt profile calculator 241 and a roller profile calculator 242 generate belt profile data and roller profile data, respectively.

The data memory 25 is adapted to store therein sets of belt profile data and roller profile data, which are generated at the operating unit 24, and sets of measurement data on accumulated travel distances of the transfer belt 5, which are input from the LDV processor 22. The printing machine 1 receives necessary belt profile data and roller profile data from the data memory 25 through an interface (non-depicted) working for communications or such.

There will be described control actions for profile generation at the profile generator 20 configured as above.

Figure 5:
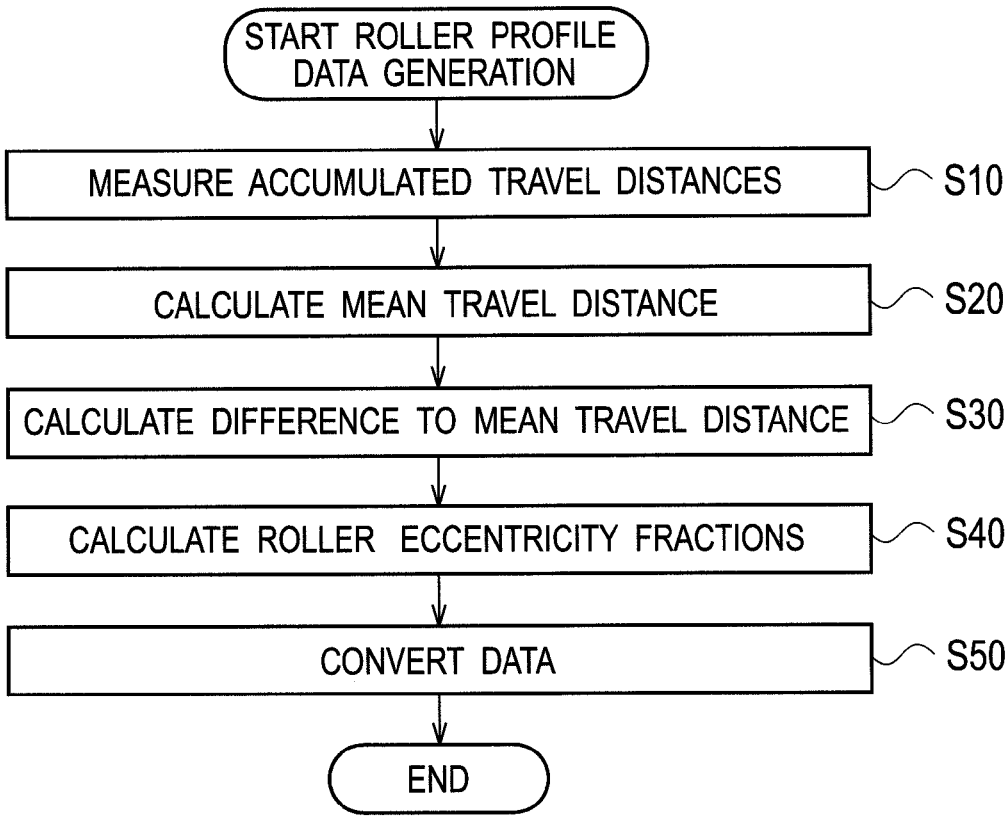
FIG. 5 is a flowchart of a procedure for generating roller profile data.

Description is first made of a generation procedure for roller profile data. FIG. 5 is a flowchart of the procedure for generating roller profile data.

For the profile generation, the transfer drive controller 14 of the printing machine 1 drives the transfer belt 5 to go around by energizing the drive motor 7.

At a step S10, the LDV processor 22 operates on the basis of the result of detection by the LDV meter 21 to estimate accumulated travel distances of transfer belt 5 at the measuring spot. It is noted that the LDV processor 22 is operable in accordance with given timing signals (e.g., belt HP signals, roller encoder pulses) for cooperation with the LDV meter 21 to sequentially provide: sets of estimated measurement data on accumulated travel distances of the transfer belt 5 (e.g., in the form of data strings each corresponding to one go-around revolution of the transfer bet 5); subsets thereof; or adequate composites thereof (e.g., set sums each corresponding to two go-around revolutions of the transfer bet 5).

This embodiment assumes '780' as the number of pulses to be output from the encoder 9 per one revolution of the driven roller 8, and assume '9,797' as the number of pulses to be output from the encoder 9 per one go-around revolution of the transfer belt 5. The driven roller 8 thus makes (9,797/780=) 12.56 revolutions per one go-around revolution of the transfer belt 5. The transfer belt 5 has an orbit length of 828 mm.

In this embodiment, the LDV processor 22 is configured to operate with a belt HP signal input from the belt HP sensor 10 to repeat calculating an accumulated travel distance of transfer belt 5 at the measuring spot for each pulse of pulse signals output from the encoder 9, in the course of providing a sequence of sets of calculation results, as a set for two go-around revolutions of the transfer belt 5.

Description is now made of characteristics of data on accumulated travel distances of transfer belt 5 as measured at the LDV processor 22. The travel distance of transfer belt 5 as accumulated should have been increased by a constant increment every pulse if the transfer belt 5 were free of irregularities in thickness and if associated rollers were non-eccentric. In that case, in a coordinate with a horizontal axis for pulse numbers and a vertical axis for accumulated travel distances, the graph of the accumulated travel distances of transfer belt 5 should be a straight linear graph representing a linear function. However, since actually the transfer belt 5 has irregularities in thickness and associated rollers are eccentric, the graph is affected when plotting data on measures of accumulated travel distances. Thus the graph shows deviations from the straight line and gets undulated with ripples of increase and decrease in value of accumulated travel distance.

At a subsequent step S20, the roller profile calculator 242 of the PC 23 calculates a mean travel distance of the transfer belt 5 based on a sequence of sets of measurement data on accumulated travel distances as acquired from the LDV processor 22.

It is noted that in this embodiment, ideally on the assumption that the transfer belt 5 is free of irregularities in thickness and associated rollers are non-eccentric and that the transfer belt 5 is moving at a constant speed, the mean travel distance corresponds to an accumulated travel distance of transfer belt 5 at the measuring spot for each pulse of pulse signals output from the encoder 9. Assuming a coordinate with a horizontal axis for pulse numbers and a vertical axis for accumulated travel distances, the mean travel distance is representative, on a straight line drawn between a coordinate value at the point of time (0 pulses) when a belt HP signal was output to start a measurement of accumulated travel distance and a coordinate value at a point of time (9,797 pulses) after one go-around revolution of the transfer belt 5 when the next belt HP signal was output, of a value thereon corresponding to a respective pulse.

In this embodiment, the LDV processor 22 is adapted to provide a sequence of sets of data on accumulated travel distances for two go-around revolutions of the transfer belt 5. In this respect, the roller profile calculator 242 is operable to: determine a sequence of such mean travel distances as described (for instance, each for one go-around revolution of the transfer belt 5) as a set for two go-around revolutions; and calculate an average thereof for two go-around revolutions, as a current data on a mean travel distance (as an average data) for use in the subsequent processing.

Figure 6:
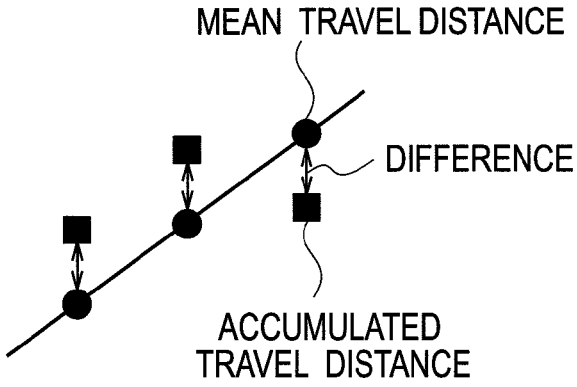
FIG. 6 is a graph describing a difference between a mean travel distance and a measurement data of an accumulated travel distance.

At a subsequent step S30, as illustrated in FIG. 6, the roller profile calculator 242 operates to calculate a difference between the mean travel distance calculated at the step S20 and a measurement data on accumulated travel distance, for each pulse. The roller profile calculator 242 is operable to determine a sequence of sets of differences for two go-around revolutions of the transfer belt 5, as a set of data (as a first set of deviation data) representing a set of deviations relative to the mean travel distance (as the average data) of measurement data.

At a subsequent step S40, the roller profile calculator 242 operates on the set of data on differences (as the first set of deviation data) calculated at the step S30 to calculate fractions therein attributable to the eccentricity of driven roller 8.

For the calculation of eccentricity-attributable fractions, the roller profile calculator 242 operates first to divide the set of difference data (as the first set of deviation data) calculated at the step S30 into subsets thereof each corresponding to one revolution of the driven roller 8 (i.e., each for an interval of 780 pulses). In this embodiment, since the driven roller 8 makes 12.56 revolutions for one go-around revolution of the transfer belt 5, the set of difference data given for two go-around revolutions of transfer belt is processed for a rounding division to provide a number of subsets thereof corresponding to 25 revolutions of the driven roller.

Figure 7A:
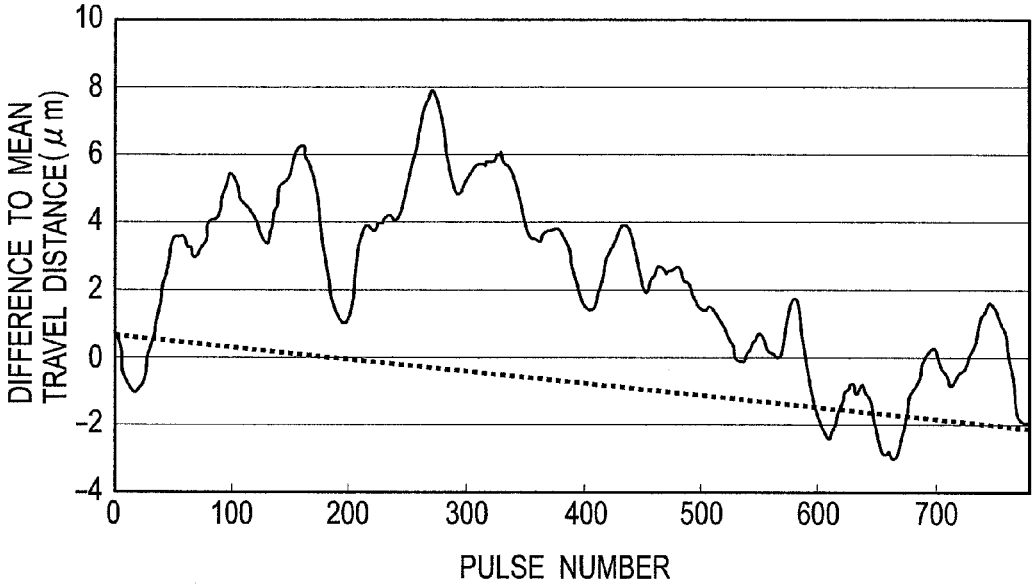
FIG. 7A is a graph showing an inclination of a data subset for one revolution of a driven roller and FIG. 7B is a graph after correction of the inclination in FIG. 7A.

Then, the roller profile calculator 242 operates to make a correction of inclination of subset of data for each roller revolution. FIG. 7A is a graph showing an inclination of a data subset for one roller revolution. In FIG. 7A, a coordinate of value at the left end (0 pulses) is different from a coordinate of value at the right end (780 pulses). That is, the graph has a straight line (illustrated by dotted lines in FIG. 7A) inclined to interconnect the coordinates with each other.

Figure 7B:
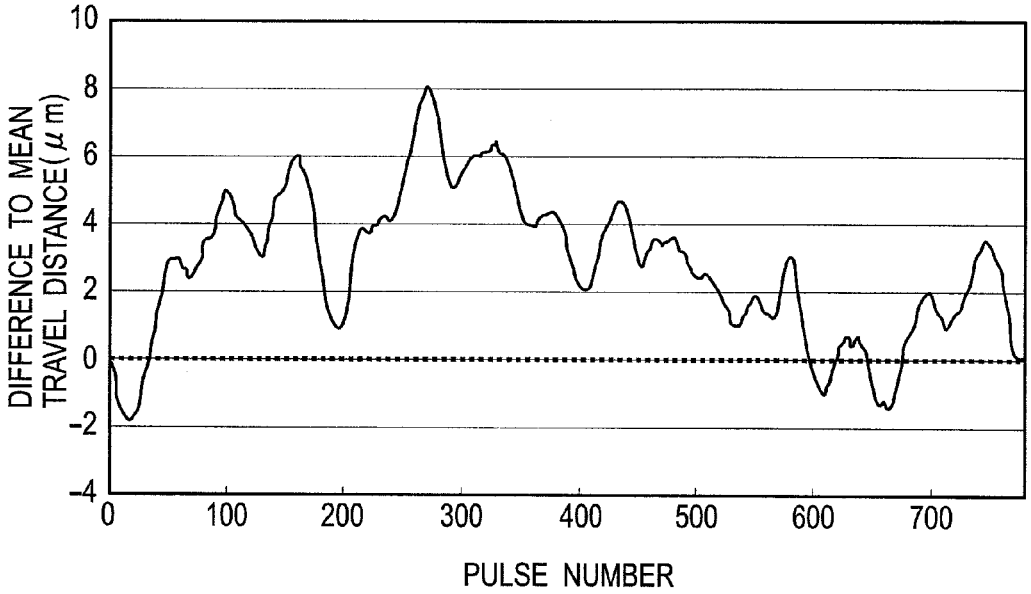

It is noted that what should be determined now is a 'set of fractions' that is attributable to the eccentricity of driven roller 8. In terms of angular position, since the driven roller 8 comes around with a single revolution thereof, such an inclination of straight line as illustrated in FIG. 7A should not involve any fraction attributable to the eccentricity of driven roller 8. To this point, the roller profile calculator 242 is operable for correction to eliminate such the inclination of difference data subset, to generate a non-inclined difference data subset as illustrated in FIG. 7B.

Figure 8:
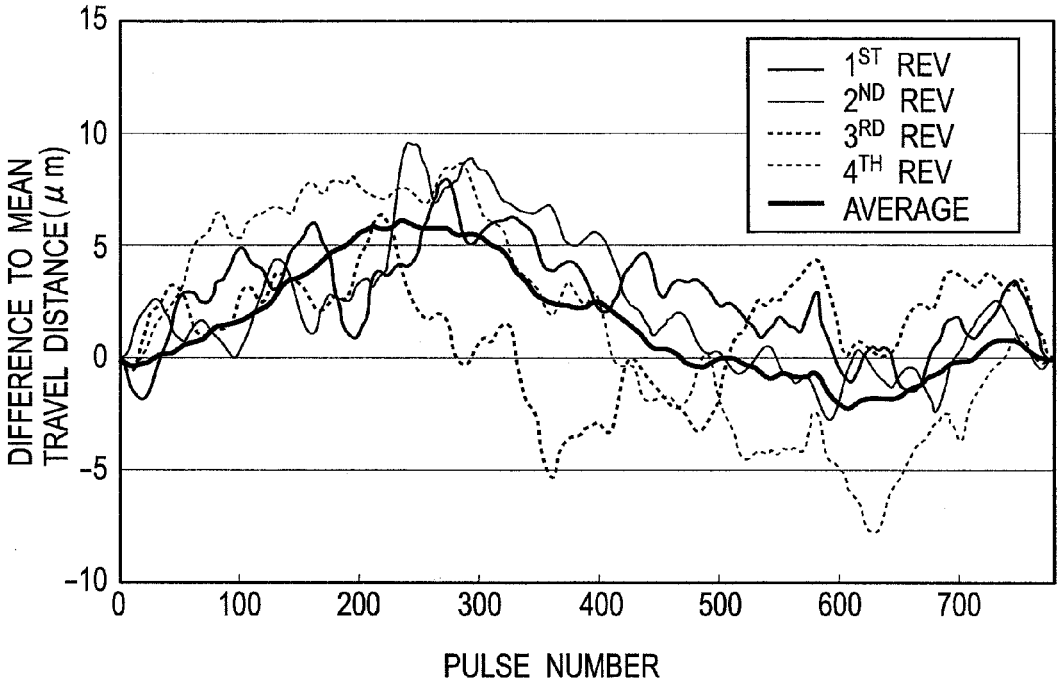
FIG. 8 is a graph showing an example of roller profile data.

Then, the roller profile calculator 242 operates to have a prescribed number of inclination-corrected difference data subsets superimposed and averaged, as illustrated in FIG. 8. For the superposition, associated data subsets are rearranged to have coordinates of their values at 0 pulses coincide with each other. Though FIG. 8 shows data subsets no more than for four roller revolutions, there are data subsets for 25 roller revolutions superimposed to average according to this embodiment. Thus a set of averaged difference data, which is taken as an average data set representative of fractions of data attributable to the eccentricity of driven roller 8, is provided as a roller profile data. Further, taking a moving average of the average data may provide an average data set with a smoothed waveform close to a sine wave free of noises, thereby allowing for a better defined roller profile data to be determined.

At a subsequent step S50, the roller profile calculator 242 operates to: convert a roller profile data calculated at the step S40 into a data adapted for use in the printing machine 1 to correct pulse signals of the encoder 9; and store the converted roller profile data in the data memory 25.

Figure 9:
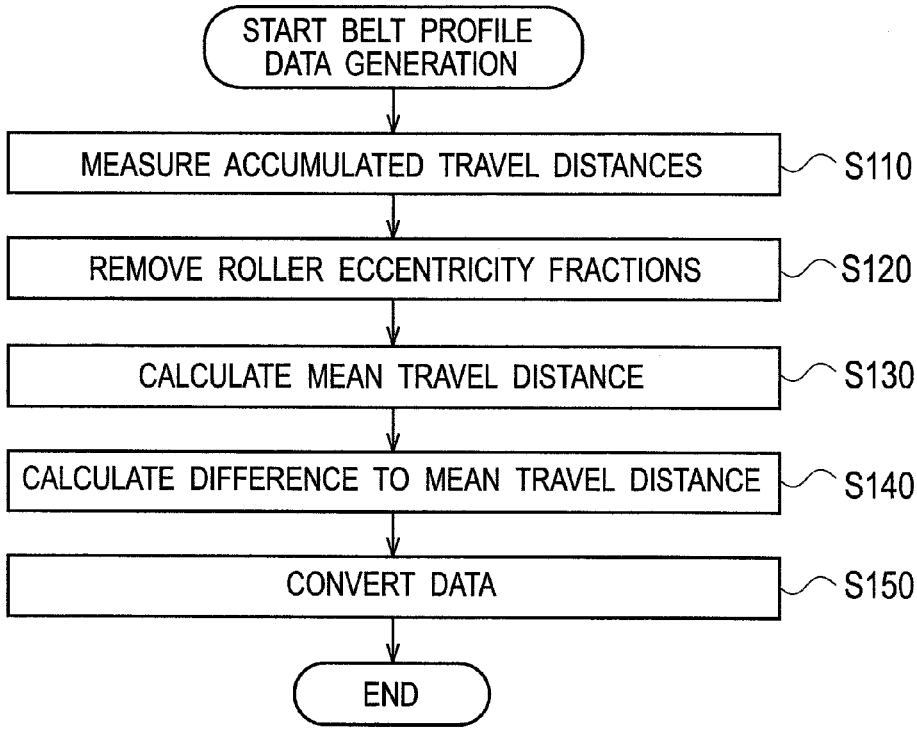
FIG. 9 is a flowchart of a procedure for generating a belt profile data.

Description is now made of a procedure for generating a belt profile data. FIG. 9 is a flowchart of the procedure for generating a belt profile data.

This procedure includes a step S110 as a step of measuring accumulated travel distances of the transfer belt 5 (i.e. by way of estimation from detected velocities), which is common to the step S10 described with reference to FIG. 5.

At a subsequent step S120, the belt profile calculator 241 operates on a sequence of sets of measurement data on accumulated travel distances of the transfer belt 5 to remove therefrom those fractions therein attributable to the eccentricity of driven roller 8 which have been calculated at the step S40 in FIG. 5. This operation involves a sub-step of removing eccentricity-attributable fractions of measurement data for one revolution of the driven roller 8 to repeat for two go-around revolutions of the transfer belt.

At a subsequent step S130, the belt profile calculator 241 operates to calculate a mean travel distance of the transfer belt 5 based on a set of measurement data on accumulated travel distances of the transfer belt 5, as it is deprived of fractions therein attributable to the eccentricity of driven roller 8. Here, the mean travel distance is determined in compliance with the concept and the calculation method described at the step S20 in FIG. 5. In other words, the belt profile calculator 241 operates on the set of measurement data deprived of eccentricity-attributable fractions to: have a sequence of mean travel distances determined therefrom, as a set for two go-around revolutions of the transfer belt 5; and calculate an average thereof as a data on a mean travel distance (as an eccentricity-removed average data) for use in the subsequent processing.

At a subsequent step S140, the belt profile calculator 241 operates to calculate a difference between the data on mean travel distance (as the eccentricity-removed average data) calculated at the step S130 and a measurement data deprived of eccentricity-attributable fraction at the step S120, for each pulse. The belt profile calculator 241 operates to determine a sequence of sets of differences as a set for two go-around revolutions of the transfer belt 5, and calculate an average thereof as a set of differences averaged every pulse. This average is handled as a set of data on differences (as a second set of deviation data) representing deviations relative to the mean travel distance of measurement data deprived of eccentricity-attributable fractions. This data set constitutes a belt profile data and is stored as a data on irregularities in thickness of the transfer belt 5 (refer to FIG. 11 to be described later on).

It is noted that instead of an average of difference sets each calculated for two go-around revolutions of the transfer belt, there may be a simple difference set calculated as it is or an average of difference sets each calculated, for one go-around revolution of the transfer belt, to take as a second set of deviation data.

At a subsequent step S150, the belt profile calculator 241 operates to: convert the belt profile data calculated at the step S140 into a data adapted for use in the printing machine 1 to correct pulse signals of the encoder 9; and store the converted belt profile data in the data memory 25. The profile generator 20 is configured for actions to generate profile data as described.

Description is now made of printing actions in the printing machine 1.

For any printing at the printing machine 1, the transfer drive controller 14 serves to energize the drive motor 7 to have the transfer belt 5 go around. The driven roller 8 is thereby driven to rotate, causing the encoder 9 to output pulse signals. As the reference mark on the transfer belt 5 is detected, the belt HP sensor 10 outputs a belt HP signal.

The discharge controller 13 is operable for use of combination of a belt profile data and a roller profile data to correct pulse signals from the encoder 9. For the correction, the discharge controller 13 works in accordance with belt HP signals to read a combination of values of belt profile data and roller profile data, for operations synchronized with a period of go-around rotation of the transfer belt 5 to correct pulse durations of pulse signals from the encoder 9. The discharge controller 13 is configured to operate on the basis of corrected pulse signals to control ink discharge timings, to advance or delay as necessary.

The head unit 4 is configured to work under control of the discharge controller 13 to propel droplets of ink onto a print sheet, thereby printing images thereon. Ink droplets are thus controlled to avoid shot deviations, with suppressed deviations in position due to irregularities in thickness of the transfer belt 5 and/or the eccentricity of driven roller 8.

Comparative Example

Description is now made of a comparative example. In the first embodiment, at the step S120, there is a sequence of sets of measurement data on accumulated travel distances of the transfer belt 5, deprived of fractions therein attributable to the eccentricity of driven roller 8, in the course of determining a belt profile data. More specifically, at the step S130, there is use of the sequence of sets of measurement data deprived of eccentricity-attributable fractions, for calculation of a mean travel distance, followed by the step S140 of calculating an average of a sequence of sets of differences between the mean travel distance and measurement data deprived of eccentricity-attributable fractions, to provide the result as the belt profile data.

To this point, the comparative example also includes necessary steps for calculating a mean travel distance based on a sequence of sets of measurement data on accumulated travel distances of the transfer belt 5, like the steps up to the step S20 in the roller profile generation procedure described with reference to the flowchart in FIG. 5. They are followed by steps of determining a sequence of sets of differences between the mean travel distance and measurement data, as a set for two go-around revolutions of the transfer belt 5, and calculating an average thereof. Then, the average of sets of differences between the mean travel distance and measurement data (determined for two go-around revolutions of the transfer belt) is processed to remove therefrom fractions therein attributable to the eccentricity of driven roller 8, to provide the result as a belt profile data.

Namely, the comparative example is different from the first embodiment in order of the step of removing fractions attributable to the eccentricity of driven roller 8. The first embodiment has a sequence of sets of measurement data deprived of eccentricity-attributable fractions, for use to determine a mean travel distance, while the comparative example calculates a mean travel distance with eccentricity-attributable fractions inclusive.

Figure 10:
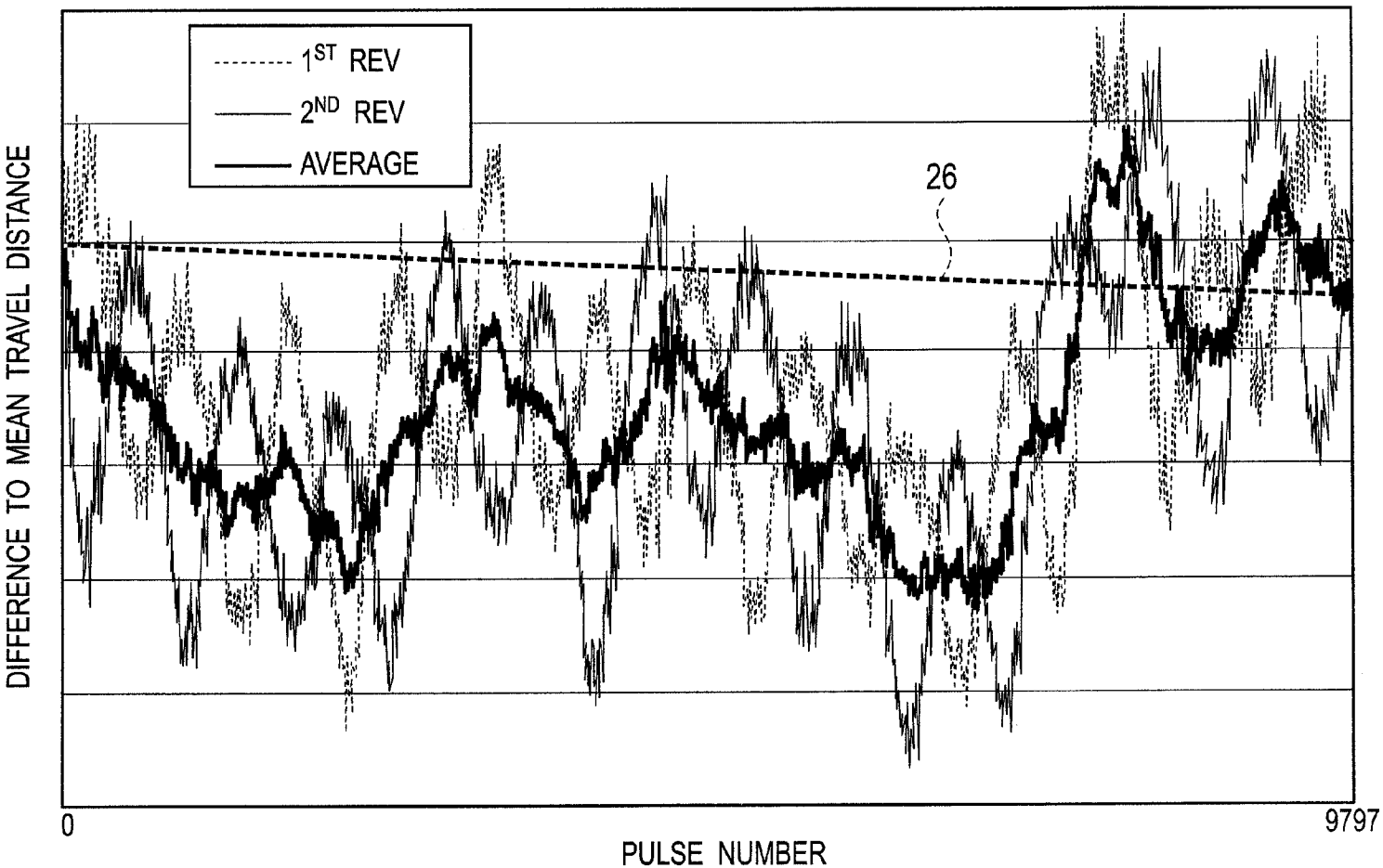
FIG. 10 is a graph showing sets of differences of measurement data to a mean travel distance in a comparative example.
Figure 11:
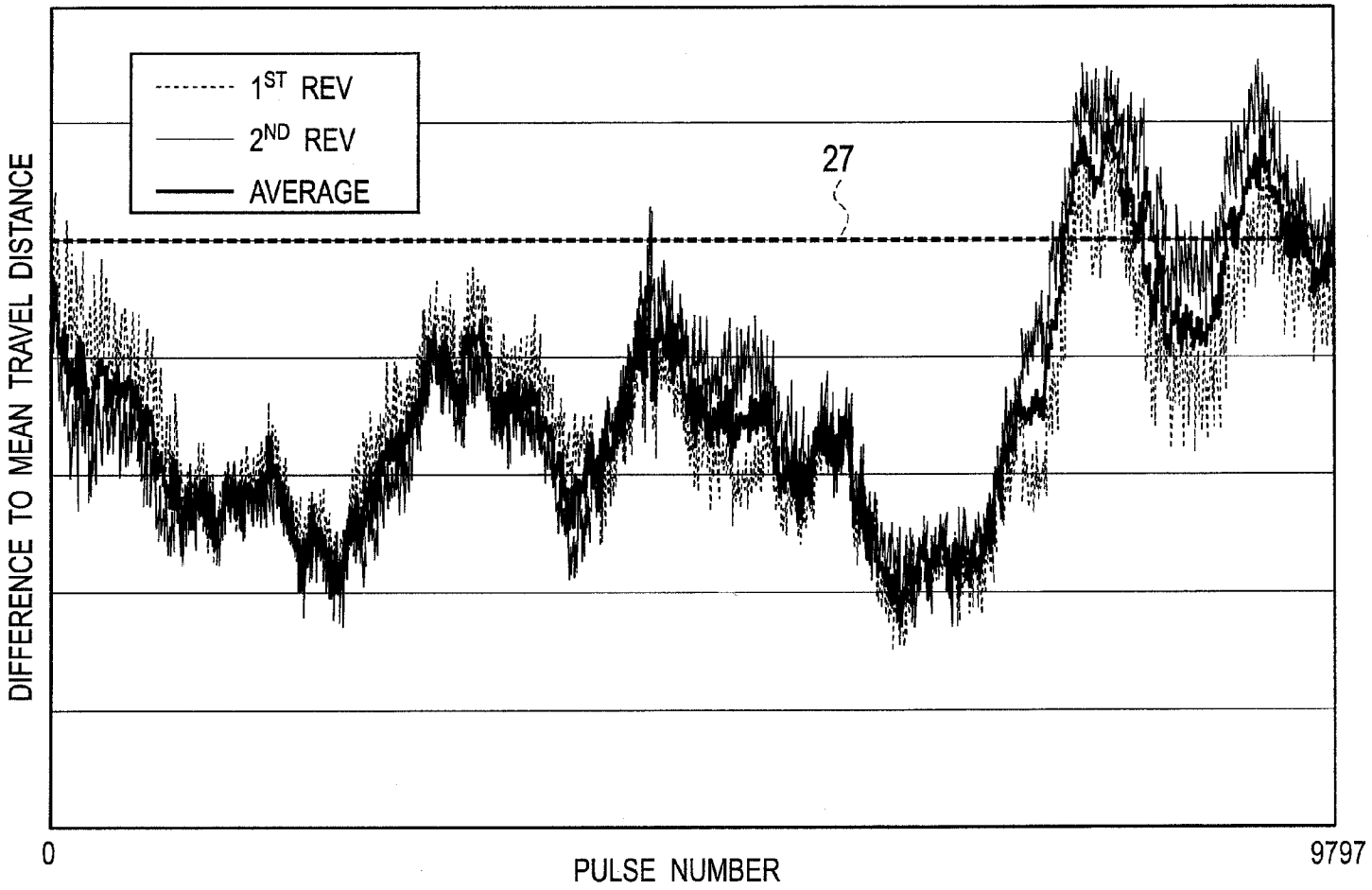
FIG. 11 is a graph showing examples of sets of differences of measurement data to a mean travel distance in the first embodiment.

FIG. 10 is a graph showing sets of differences of measurement data to a mean travel distance in the comparative example, and FIG. 11, a graph showing examples of sets of differences of measurement data to a mean travel distance in the first embodiment. In FIG. 10, as well as in FIG. 11, there are plotted sets of difference values for two go-around revolutions of the transfer belt 5, and a set of averaged difference values in between. It is noted that the set of averaged difference values in FIG. 11 corresponds to the second set of deviation data calculated at the step S140 in FIG. 9.

In FIG. 10, the set of averaged difference values plotted (for two go-around revolutions of the transfer belt 5) has a coordinate of difference value at the left end (0 pulses) different from a coordinate of difference value at the right end (9,797 pulses), with a straight line inclined to interconnect the coordinates with each other. The transfer belt 5 does return to its original position with a single go-around revolution, so in any belt profile data being a difference set, its coordinate of difference value at the left end (0 pulses) should coincide with a coordinate of difference value at the right end (9,797 pulses). Failed coincidence reveals an incorrectness of the belt profile data.

To this point, in FIG. 11, (in the set of averaged difference values for two go-around revolutions of the transfer belt) there is a coordinate of difference value at the left end (0 pulses) substantially coincident with a coordinate of difference value at the right end (9,797 pulses), with a straight line 27 non-inclined to interconnect the coordinates at both ends with each other.

Instead, FIG. 10 shows an inclined straight line 26, the reason why will be discussed.

Figure 12:
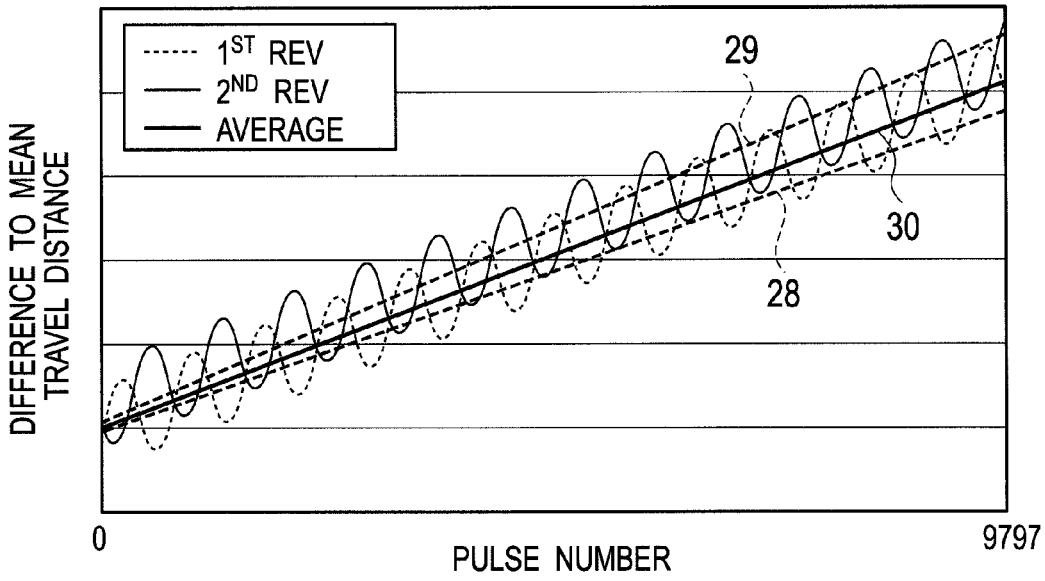
FIG. 12 is a schematic graph describing sets of measurement data on accumulated travel distances for two go-around revolutions of a transfer belt.

FIG. 12 is a schematic graph describing sets of measurement data on accumulated travel distances for two go-around revolutions of the transfer belt. FIG. 12 shows straight lines 28 and 29, described each as an interconnecting straight line between a coordinate of accumulated travel distance at the left end (0 pulses) and a coordinate of accumulated travel distance at the right end (9,797 pulses), for a first and a second round of measurement data along go-around revolutions of the transfer belt, respectively. They represent mean travel distances of the first and the second round of measurement data. A straight line 30 represents average values in between.

The first and second rounds of measurement data along go-around revolutions of the transfer belt represent sets of accumulated travel distances, each involving a sequence of subsets of a set of fractions attributable to the eccentricity of driven roller 8. Here, for instance, the first round provides an accumulated travel distance at the right end (9,797 pulses) with an eccentricity-attributable fraction superimposed thereon in the positive direction, and the second round provides an accumulated travel distance at the right end (9,797 pulses) with an eccentricity-attributable fraction superimposed thereon in the negative direction, whereby as shown in FIG. 12, the straight lines 28 and 29 have different inclinations. Such relationships will appear unless the revolution number of driven roller 8 associated with a revolution number of the transfer belt 5 is equal to an integral multiple of the latter. The comparative example employs such the sets of measurement data on accumulated travel distances, to calculate therefrom sets of differences relative to a mean travel distance, which takes a value on the straight line 30 that is an average between the two rounds described, so this mean travel distance is deviated from an inherent value. As a result, in FIG. 10, the straight line 26 is inclined.

To this point, the first embodiment includes processing a set of measurement data on accumulated travel distances to remove therefrom fractions therein attributable to the eccentricity of driven roller 8, followed by processing the set of measurement data deprived of eccentricity-attributable fractions to determine therefrom a mean travel distance, so the mean travel distance determined gets well close to an inherent value, allowing for generation of a correct belt profile data.

It is noted that FIG. 11, compared with FIG. 10, shows three data sets being a first and a second round of data, and a set of average data in between, while as will be see from FIG. 11 according to the first embodiment, those data sets are little different. This is because, as described, the set of measurement data deprived of eccentricity-attributable fractions is processed to determine therefrom a mean travel distance, affording to provide a mean travel distance close to an inherent value.

Therefore, in a method according to the first embodiment, instead of determining an average of difference sets for two go-around revolutions of the transfer belt, there may well be a simple difference set calculated as it is for any go-around revolution, to take as a second set of deviation data, as described at the step S140 in the flowchart of FIG. 9.

(Shot Deviation Check)

The printing machine 1 is adapted to undergo a test for shot deviation check including printing an image pattern for evaluation under a test mode, using a scanner to read printed images, and applying scanned image data to a dedicated tool for analyses (non-depicted), checking degrees of shot deviations. To implement such a shot deviation check, there is an effective method, which will be described.

In the course to make a print under the test mode, the printing machine 1 works to use a belt HP signal from the belt HP sensor 10, for synchronization between belt position and sheet position (as a print start position).

Figure 13:
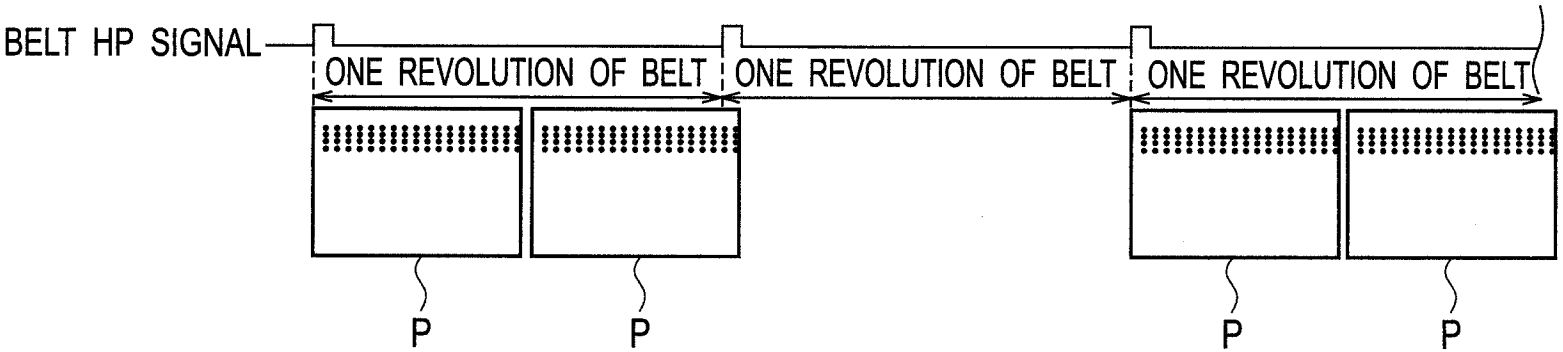
FIG. 13 is a chart of timings for print services under a test mode.

More specifically, at the printing machine 1, the system controller 15 works to control the discharge controller 13, having the drive controller 14 control the transfer drive set 16, to operate at a timing of a belt HP signal output from the belt HP sensor 10, to start a print service for a consecutive printing on two sheets P of an A3 size, interrupted after completion of the printing, and operate at a timing of a belt HP signal subsequently output, to start another print service for a similar printing on two sheets P of an A3 size. FIG. 13 shows timings for those print services.

In this embodiment, the transfer belt 5 has a circumferential length of 828 mm, as described. Since the A3 size of sheet is 420 mm at the longer side, each print service started at the timing of an output belt HP signal is programmed to initiate a printing at a head position of consecutive two sheets and continue the printing thereover, to provide frames of images thereon, which are applicable to the dedicated tool for analyses, affording to detect degrees of shot deviations of one round or for one go-around revolution of the transfer belt.

Figure 14:
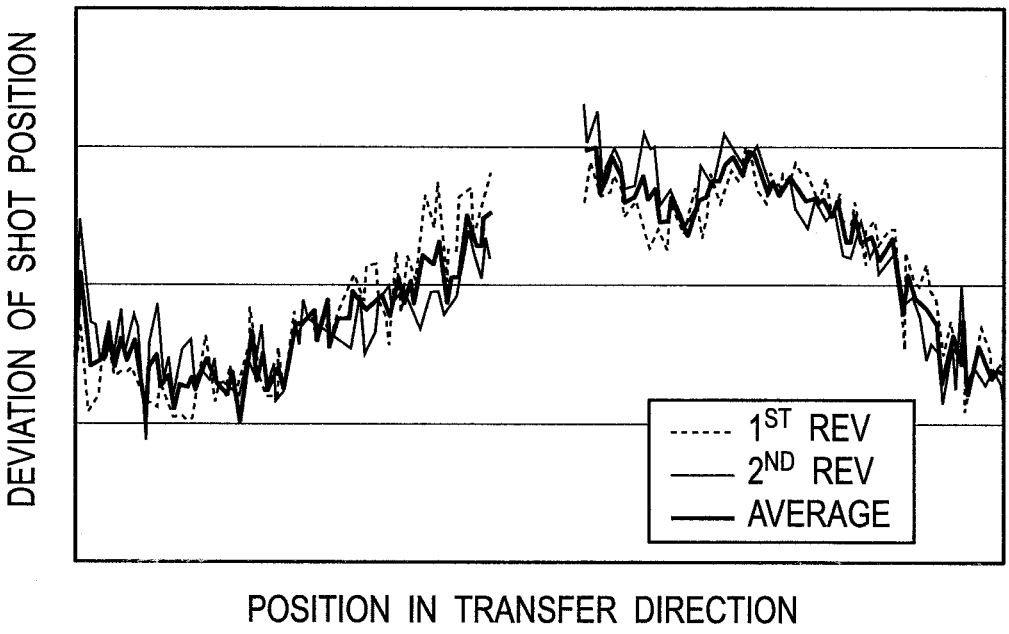

As illustrated in FIG. 13, there are two image sets each printed on two sheets, for use to detect sets of data on degrees of shot deviations, each as a set for one go-around revolution of the transfer belt. FIG. 14 is a graph showing examples of a first and a second set of data on degrees of shot deviations and the average data in between. The set of average data is an average taken between the first and the second set of data, to possibly remove noise fractions in data else than shot deviations due to periodical factors such as irregularities in thickness of the transfer belt 5. There may be noise fractions involving shot deviations due to irregularities in discharge of ink heads. It is noted that in FIG. 14 given sets of shot deviations are examples for services else than those using profile data to control discharge timings, and interruption of data at a central interval of the graph corresponds to a space between pairs of consecutive sheets.

The set of average data on degrees of shot deviations in FIG. 14 is comparable with belt profile data obtained in a described manner, for instance, to permit a check at the user end such as for errors in the belt profile data. In comparison with the data in FIG. 14, if the belt profile data is different in a tendency (such as amplitude or phase), then it is doubtful that the belt profile data is erroneous.

Further, under the test mode, belt profile data and roller profile data may be used for a discharge timing control to provide print services shown in FIG. 13 to: print images for application to the dedicated tool for analyses; and check if shot deviations are dissolved in the printed images.

As will be seen from the foregoing, in the course of determining a belt profile data, the first embodiment includes processing a set of measurement data on accumulated travel distances of the transfer belt 5 to remove therefrom fractions therein attributable to the eccentricity of driven roller 8, using the set of measurement data after removal of eccentricity-attributable fractions to calculate therefrom a mean travel distance (as an eccentricity-removed average data), and calculating a set of differences between the mean travel distance and measurement data after removal of eccentricity-attributable fractions, to provide the difference set as the belt profile data. This permits calculation of a correct belt profile data, allowing for suppressed shot deviations of ink in the printing.

Although the first embodiment employs a set of measurement data on accumulated travel distances of the transfer belt 5 to generate a roller profile data and a belt profile data, there may be use of a set of measurement data on travel speeds of the transfer belt 5. Travel speeds of the transfer belt 5 can be obtained from the LDV meter 21.

In this case, in the course of generating a roller profile data, the LDV processor 22 gets a sequence of sets of data on travel speeds of the transfer belt 5 each obtained at the measuring spot per one pulse of pulse signals from the encoder 9, as a set for two go-around revolutions of the transfer belt 5.

Then, the roller profile calculator 242 processes the set of data on travel speeds each as a measure per one pulse of pulse signals from the encoder 9, to: determine a sequence of data on averaged travel speeds as a set for two go-around revolutions of the transfer belt 5; and provide a data averaged for pulses along the two go-around revolutions of the transfer belt for use as a data on a mean travel speed (as an average data) in a subsequent processing.

Then, the roller profile calculator 242 operates to calculate a sequence of sets of speed ratios each being a ratio of a measurement data (on a travel speed) to the mean travel speed (as the average data). The roller profile calculator 242 then determines the sequence of sets of speed ratios, as a set for two go-around revolutions of the transfer belt 5, to provide as a set of data on deviations (as a first set of deviation data) to the mean travel speed (as the average data) of measurement data.

Then, the roller profile calculator 242 operates for use of the set of data on thus determined speed ratios (as the first set of deviation data), to calculate fractions therein attributable to the eccentricity of driven roller 8. The roller profile calculator 242 then operates to divide the set of data on speed ratios, into subsets thereof each corresponding to one revolution of the driven roller 8, superimpose 25 subsets of data for two go-around revolutions of the transfer belt 5 (i.e. 25 revolutions of the driven roller 8), and calculate an average thereof to determine a set of data on fractions attributable to the eccentricity of driven roller 8, to provide this data set as the roller profile data.

Further, there is a course to generate a belt profile data, in which the belt profile calculator 241 operates for processing the sequence of sets of measurement data on travel speeds of the transfer belt 5, to remove from each set thereof the set of data on fractions attributable to the eccentricity of driven roller 8. That is, there is an operation on each set of measurement data obtained for one revolution of the driven roller 8, to remove therefrom eccentricity-attributable fractions therein, the operation being repeated for two go-around revolutions of the transfer belt 5. Here, the set of data on eccentricity-attributable fractions is given as a set of data on speed ratios, so this data set is multiplied by the mean travel speed to convert into a speed data set, before removal thereof from each set of measurement data on travel speeds.

Then, the belt profile calculator 241 operates on each set of measurement data on travel speeds of the transfer belt 5 after removal of fractions attributable to the eccentricity of driven roller 8, to calculate a mean travel speed of the transfer belt 5. Such mean travel distances are calculated from sets of measurement data on travel speeds of the transfer belt 5 after removal of eccentricity-attributable fractions, for two go-around revolutions of the transfer belt 5, and averaged to provide a data on a mean travel speed (as an eccentricity-removed average data), for use in a subsequent processing.

Then, the belt profile calculator 241 operates to have a speed ratio of a measurement data (on a travel speed) after removal of an eccentricity-attributable fraction, calculated for one pulse, to the mean travel speed determined above (as the eccentricity-removed average data). The belt profile calculator 241 then determines such speed ratios every pulse, to provide sets thereof for rounds for two go-around revolutions of the transfer belt 5, and calculates a set of average data in between. This data set of averaged speed ratios is given as a set of data (as a second set of deviation data) representing deviations to the mean travel speed of measurement data after removal of eccentricity-attributable fractions. This constitutes the belt profile data. It is noted that instead of an average calculated for rounds for two go-around revolutions of the transfer belt, there may be a speed ratio set calculated as it is for one go-around revolution of the transfer belt, to take as a second set of deviation data.

In this way, there can be also use of measurement data on travel speeds of the transfer belt 5 to generate roller file data and belt profile data. Finally, such profile data is employed as a change ratio (in percent) to a constant speed, to correct discharge timings, so it is same whether the measurement data is a distance or a speed.

Second Embodiment

Description is now made of a printing system according to a second embodiment, which is different from the printing system according to the first embodiment, in that it has a printing machine 1 including one or more cameras additionally provided to take frames of local images at prescribed timings of a dedicated chart on any of a prescribed number of test sheets (e.g. two sheets of a dedicated chart 41 for size A3 in FIG. 17) exceeding a whole circumference of a transfer belt 5, as the belt 5 moves carrying the sheets.

Any camera is mounted in position so that any image frame taken has its center on a straight line preset as a reference for alignment of any line of nozzles at any ink head of a head unit 4. This embodiment includes a camera 40 mounted on an ink head 4A.

Figure 15:
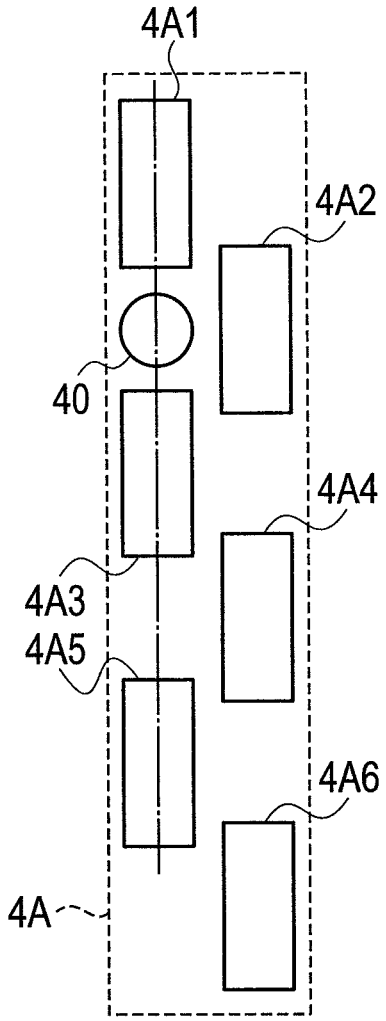
FIG. 15 is a plan view showing a camera mounted on an ink head of a printing machine constituting a printing system according to a second embodiment.

FIG. 15 is a plan view showing the camera 40 mounted on the ink head 4A. As illustrated in FIG. 15, the ink head 4A includes two sets of three unit heads 4A1, 4A3, 4A5 and 4A2, 4A4, 4A6 staggered in the sheet transfer direction. The camera 40 mounted on the ink head 4A is disposed between the unit heads 4A1 and 4A3, as illustrated in FIG. 15, for instance. Accordingly, the camera 40 is arranged so that any image frame taken has its center on a straight line preset for alignment of a line of nozzles in the set of unit heads 4A1, 4A3, and 4A5.

Figure 16:
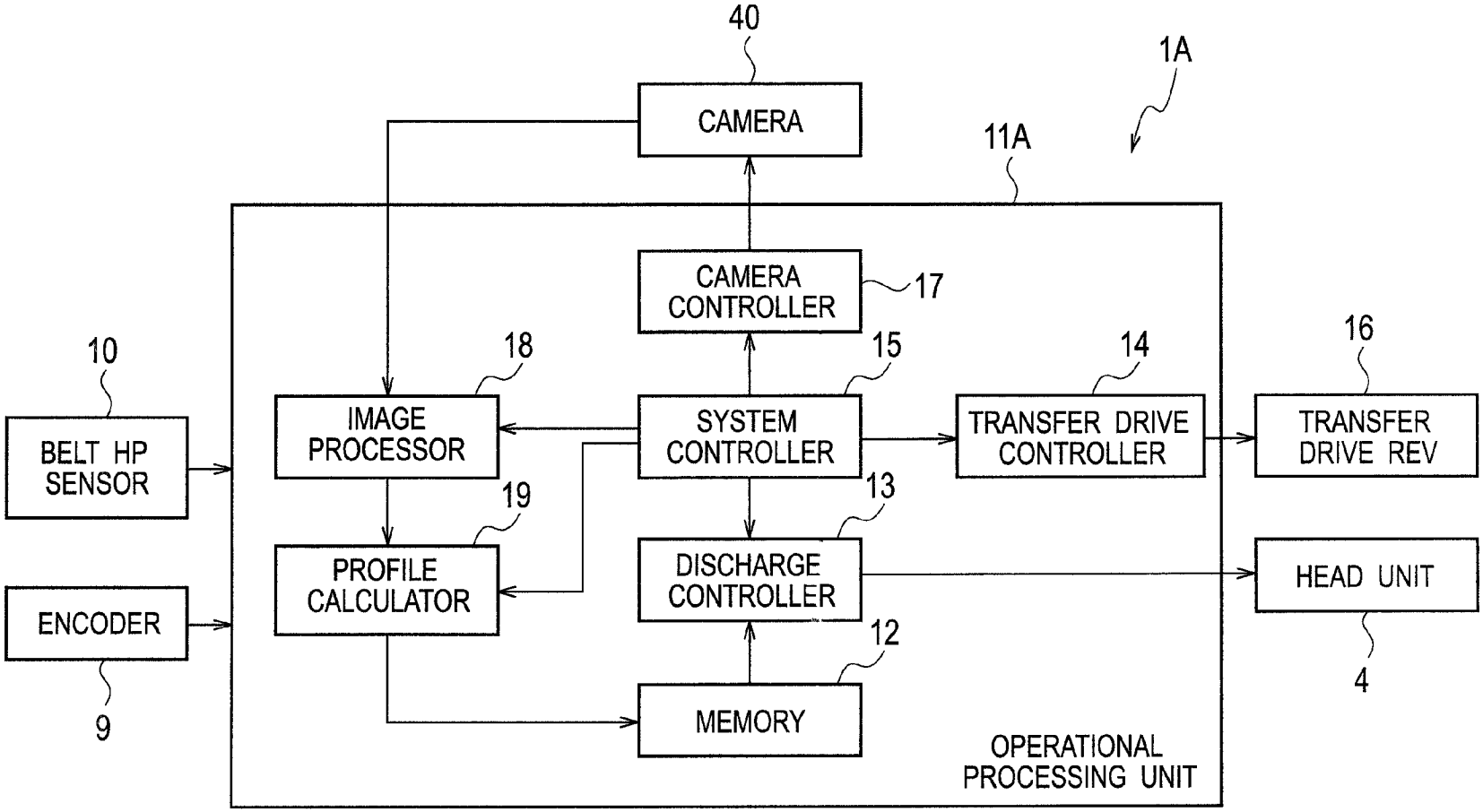
FIG. 16 is a block diagram showing a configuration of a control system for the printing machine constituting the printing system according to the second embodiment.

FIG. 16 is a block diagram showing configuration of a control system for a printing machine 1A constituting the printing system according to the second embodiment. As shown in FIG. 16, the printing machine 1A is configured with an operational processing unit 11A substituting for the operational processing unit 11 in the printing machine 1 constituting the printing system according to the first embodiment. The operational processing unit 11A has a configuration including a camera controller 17, an image processor 18, and a profile calculator 19, as they are additionally provided to the operational processing unit 11 shown in FIG. 2.

Unlike the printing machine 1 constituting the printing system according to the first embodiment including the memory 12 with a belt profile data and a roller profile data stored therein, the printing machine 1A constituting the printing system according to the second embodiment has a memory 12 for storing therein a profile data representative of irregularities in thickness of the transfer belt 5 and the eccentricity of driven roller 8.

The camera controller 17 is configured to control image taking actions of the camera 40. The camera controller 17 is responsible for the camera 40 to take a frame of images at any timing based on a trigger signal input thereto from a system controller 15. In actual printing, the trigger signal serves as a signal that represents a discharge timing programmed to propel out droplets of ink onto a print sheet, to form a line or lines of "dots or cells" thereon (referred herein, each respectively collectively, to as a "dot" that consists of a set of pixels). Inherently, those droplets of ink should be propelled onto such locations on the print sheet that one-to-one correspond to positions of those dots on a dedicated chart, which are aligned as a dot row or dot rows arrayed in the (columnar) sheet transfer direction. More specifically, for the camera 40 disposed as illustrated in FIG. 15, the trigger signal serves to determine a discharge timing for causing the set of unit heads 4A1, 4A3, and 4A5 to propel droplets of ink through their nozzles, inherently onto such locations on a print sheet that correspond to positions of aligned dots on a dedicated chart, to form a line or lines of dots on the print sheet.

The image processor 18 is operable to process frames of images of dots on local regions of a dedicated chart sequentially taken by the camera 40, for calculations to determine positional deviations of dots in the image frames relative to centers of the frames, respectively.

The profile calculator 19 is configured to operate on the basis of positional deviations of dots calculated at the image processor 18 to generate a profile data, and store the profile data in the memory 12.

Figure 17:
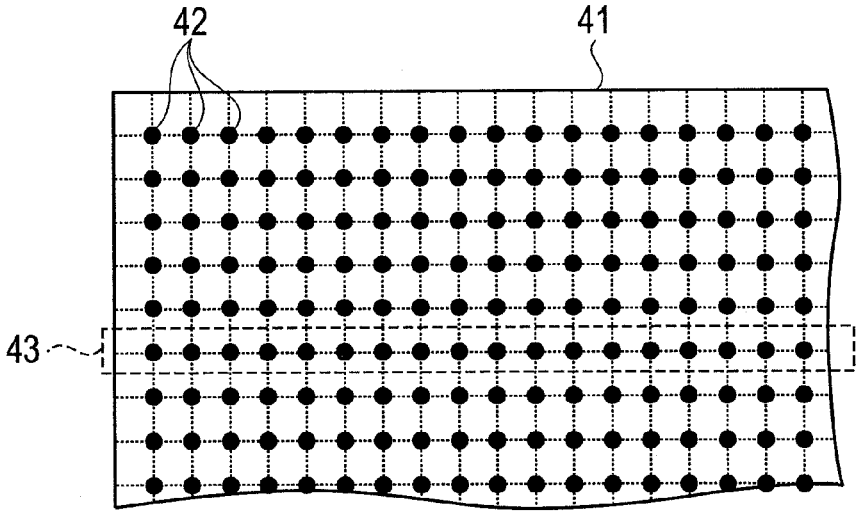
FIG. 17 is an illustration of part of a dedicated chart on a test sheet

FIG. 17 is an illustration of part of a dedicated chart 41 on a test sheet in use for generation of a profile data according to the second embodiment. As illustrated in FIG. 17, the dedicated chart 41 is a matrix of dots 42 printed at prescribed intervals on the sheet. The matrix of dots 42 is formed with a high positional precision such as by an offset printing. The narrower the dot intervals are set, the higher the precision of a generated profile becomes. For possible limits of dot intervals to be narrowed, there are bounds due to the shutter speed of the camera 40 and the sheet travel speed in the printing machine 1A.

Description is now made of actions for profile generation in the printing machine 1A.

In the course of profile generation, someone in charge is required to set sheets of a dedicated chart 41 on a non-depicted feeder rack. Afterward, the system controller 15 serves for operation of a transfer drive controller 14 to control a set of transfer drives 16 to feed consecutive sheets of dedicated chart 41 in synchronism with belt HP signals from a belt HP sensor 10, while outputting trigger signals to the camera controller 17. The camera controller 17 controls the camera 40 to have a shutter click in accordance with trigger signals. The camera 40 is thereby operated to sequentially take a frame of image of such a set of one or more dots in a row or rows 42 that constitutes a dot column 43 as shown in FIG. 17 for instance.

The transfer belt 5 has a circumference length of 828 mm. Each sheet of size A3 has a length of 420 mm along the longer side. Hence, consecutive transfer of two sheets of a dedicated chart 41 for size A3 affords to take sequential frames of images of such dots in rows 42 that constitute the dot column 43, for use to detect positional deviations of dots in rows 42 for one go-around revolution of the transfer belt 5.

The trigger signal serves as a signal indicating a discharge timing to propel droplets of ink on such locations on a print sheet that correspond to positions of dots in rows 42 on a sheet of dedicated chart 41, as described. Ideally, assuming a constant travel speed of the transfer belt 5 free of variations in travel speed due to thickness irregularities and/or roller eccentricity, there should be sequential frames of images taken by the camera 40, with their centers coincident on centers of dots in rows 42 in images of dedicated chart 41.

Figure 18:
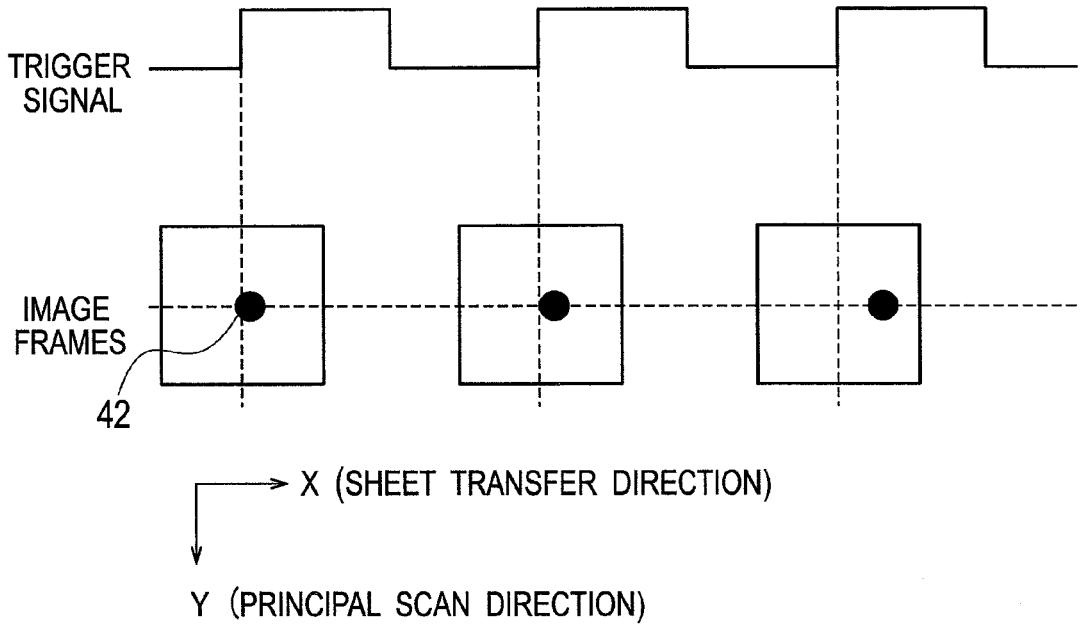
FIG. 18 is an illustration of positions of dots in frames of images taken by the camera in FIG. 15.

Instead, as the travel speed of transfer belt 5 is varied due to thickness irregularities and/or roller eccentricity, there are sequential frames of images taken with their centers deviated relative to centers of dots in rows 42 in images of dedicated chart 41, as illustrated in FIG. 18.

In situations where the travel speed of transfer belt 5 is increased from a constant speed free of speed variations, there is a set of an image or images of a dot or dots in a row or rows 42, taken with a center or centers thereof deviated in a positive sense (the right hand in FIG. 18) of an X direction that is the sheet transfer direction.

The image processor 18 is operable for acquisition a sequence of frames of images taken by the camera 40, to determine frame by frame a directionally positive or negative number of pixels residing between a center of a frame and a center of a set of images of pixels of a dot in a row 42, converting the pixel number into a commensurate distance. This distance represents an amount or degree of local deviation of the dot in the row 42.

There may be an inadvertent oblique run of a sheet of dedicated chart 41 causing images of dots in rows 42 to deviate from centers of associated image frames, not simply in the X direction but also in a Y direction (as a principal scan direction), respectively. In such situations, the image processor 18 is operable to simply take deviation components in the X direction, for calculations to determine deviations amounts.

It is noted that there may be offset fractions of deviation such as due to a significant interval of time from a trigger signal input to a shutter click of the camera 40. The image processor 18 is operable to cut such fractions.

The profile calculator 19 is configured for operations on deviation amounts calculated at the image processor 18 to determine therefrom local change ratios of travel speed of the transfer belt 5. For a dot in a row 42 on a sheet of dedicated chart 41, assuming 5 mm as a center-to-center distance, and 0.1 mm as a deviation amount determined at the image processor 18, for instance, the change ratio calculated equals to 0.1/5=0.02 (=2 percent).

Figure 19:
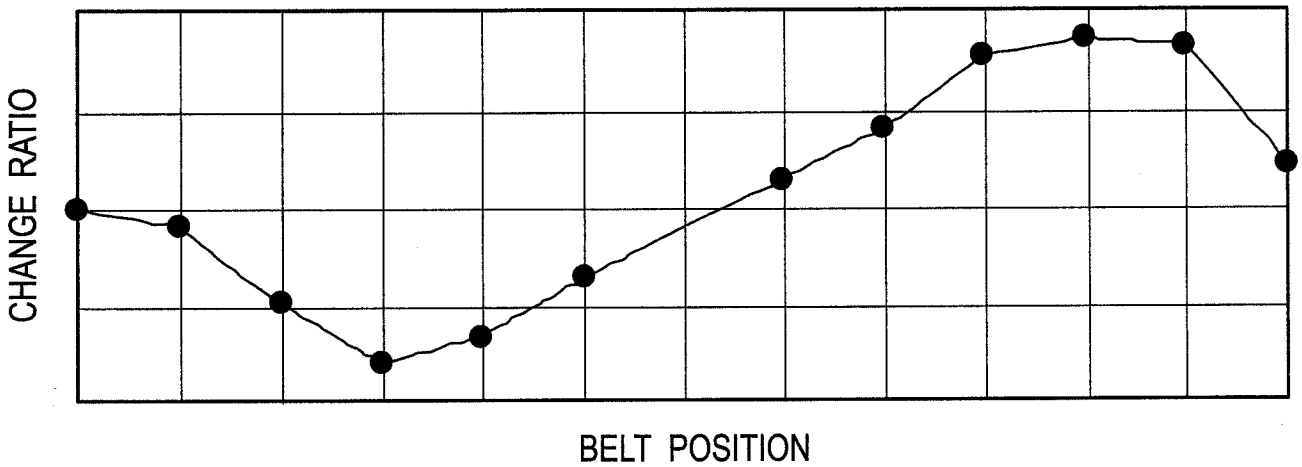
FIG. 19 is a graph showing an example of a set of data on ratios of variations in travel speed of a transfer belt in the printing machine constituting the printing system according to the second embodiment.

The profile calculator 19 is operable for calculations to determine change ratios for one go-around revolution of the transfer belt 5 to provide as a set of data on change ratios, as illustrated in FIG. 19 for instance.

The profile calculator 19 is operable for processing such the set of change ratios to generate a profile data in the course of providing a final profile data that is a set of data adapted to correct a pulse width of each pulse output from an encoder (one go-around revolution of the transfer belt 5 corresponding to 9,797 pulses). In this regard, since such change ratios are each given for one dot in a row 42 constituting a dot column 43, they are different from change ratios corresponding to pulses from the encoder 9. To this point, the profile calculator 19 is adapted for use of an inter-dot linear interpolation to calculate change ratios one-to-one corresponding to pulses from the encoder 9. There is a set of change ratios thus prepared to be one-to-one correspondent to pulses from the encoder 9, to provide as the final profile data.

Then, the profile calculator 19 operates to convert the thus calculated profile data into a data adapted for use to correct pulse signals of the encoder 9 in the course of printing, and store the converted profile data in the memory 12.

In the printing course, there are services provided by a discharge controller 13 to: read the profile data from the memory 12; work thereon for correction of pulse signals from the encoder 9; and operate on the basis of corrected pulse signals to control ink discharge timings, to advance or delay as necessary.

The discharge controller 13 then controls a head unit to propel out droplets of ink onto a sheet, printing images thereon.

As will be seen from the foregoing description, according to the second embodiment, there is a combination of steps of taking frames of images of dots in rows 42 on a sheet of dedicated chart 41 being fed, and generating a profile data based on positions of dots in rows 42 in taken image frames. Therefore, the profile data generated can reflect behaviors of a sheet actually fed, allowing for suppressed shot deviations of ink when printing.

Further, there is no need of external devices used for profile data generation, affording for the user or service personnel to render on-site services to generate a profile data with ease. Therefore, even with occurrences of variations with time or in environment, the printing machine 1A is permitted to receive on-site services of the user or service personnel to generate a profile data adapted for use under such variations.

It is noted that the use of a dedicated chart 41 may be replaced by use of an ink head at an upstream end in the sheet transfer direction to propel out droplets of ink to form a matrix of dots on a sheet, followed by use of a camera mounted on an ink head at a downstream end to take frames of images of dots to be based on to generate a profile data.

For instance, there may be use of a camera 40 mounted on an ink head 4B. This camera 40 may be arranged for any image frame taken to have its center on a straight line preset for alignment of a line of nozzles in the ink head 4B.

In the course of generating the profile, the printing machine 1 may work for feeding blank sheets P, propelling out droplets of ink from an ink head 4A onto the sheets P, forming matrices of dots thereon, and using the camera 40 for taking frames of images of dots at prescribed timings. The timings to take frames of images may be set each identical to a corresponding discharge timing at the ink head 4B, to propel out droplets of ink from the ink head 4B onto locations of dots of corresponding dot line formed by the ink head 4A.

The image processor 18 may operate for processing frames of images of dots taken by the camera 40, to calculate positional deviations of dots relative centers of frames of images, respectively. The profile calculator 19 may operate for processing deviations thus calculated at the ink head 4B relative to the ink head 4A as a reference, to generate a profile data. For such the course of processing deviations between two colors to generate a profile data, there may be use of a known technique, for instance, disclosed in Japanese Patent Application Laying-Open Publication No. 2007-276286.

In this manner, it is also possible to generate a profile data reflecting behaviors of a sheet being transferred, allowing for suppressed shot deviations of ink when printing.

The present application claims the benefit of priority under 35 U.S.C. §119 to Japanese Patent Application No. 2010-139434, filed on Jun. 18, 2010, the entire content of which is incorporated herein by reference.

What is claimed is:

1. A printing system comprising:

a set of rollers;

a transfer belt driven by the set of rollers to transfer a sheet;

an ink head configured to propel droplets of ink onto the sheet put on the transfer belt;

a measuring element configured to generate travel distance measurement data, wherein the travel distance measurement data is a set of measurements of travel distances of the transfer belt at a prescribed measuring spot and also at intervals with a prescribed rotation angle of one of the set of rollers, and the travel distance measurement data is a set for one or more go-around revolutions of the transfer belt at a prescribed measuring spot;

a roller profile calculator configured to calculate a roller profile data;

a belt profile calculator configured to calculate a belt profile data; and a discharge controller configured to control timing for discharge of ink to the sheet at the ink head based on the belt profile data and the roller profile data, wherein the roller profile data is a set of fractions attributable to an eccentricity of the set of rollers in the travel distance measurement data obtained at the measuring element, the belt profile data is representative of irregularities in thickness of the transfer belt, the roller profile calculator calculates a mean travel distance which represents an accumulated travel distance of the transfer belt under condition that the transfer belt is traveling at a constant speed, based on the travel distance measurement data, calculates deviation data which represents a difference between the mean travel distance and the travel distance measurement data, and calculates the roller profile data based on the deviation data, and the belt profile calculator calculates eccentricity-removed data by subtracting the roller profile data from the travel distance measurement data, calculates eccentricity-removed average data which corresponds to an accumulated travel distance of transfer belt under condition that the transfer belt is traveling at a constant speed, based on the eccentricity-removed data, and calculates the belt profile data which represents a difference between eccentricity-removed data and eccentricity-removed average data.

2. The printing system according to claim 1, wherein the roller profile calculator divides the deviation data into subsets each corresponding to one revolution of the roller, and have the subsets superimposed for averaging a number of go-around revolutions to provide a set of average data as the roller profile data.

* * * * *